US005996495A

United States Patent [19]

Hara

[11] Patent Number: 5,996,495

[45] **Date of Patent: *Dec. 7, 1999**

[54] CYLINDER CLEANING DEVICE

[75] Inventor: Akira Hara, Tokyo, Japan

[73] Assignee: Baldwin-Japan Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/891,656

[22] Filed: Jul. 11, 1997

[30] Foreign Application Priority Data

Jul. 16, 1996 [JP] Japan ..... 8-205394

[51] Int. Cl.[6] ..... B41F 35/00

[52] U.S. Cl. ..... 101/425; 101/423

[58] Field of Search ..... 101/425, 423, 101/424; 150/256.51, 256.5

[56] References Cited

U.S. PATENT DOCUMENTS

| | | | |
|---|---|---|---|
| 3,893,663 | 7/1975 | Sanchez et al. | 271/21 |
| 5,282,420 | 2/1994 | Hara et al. | 101/423 |
| 5,516,384 | 5/1996 | Mossbeck | 156/194 |

FOREIGN PATENT DOCUMENTS

| | | | |
|---|---|---|---|
| 0315144 | 5/1989 | European Pat. Off. . | |
| 0590195 | 4/1994 | European Pat. Off. . | |
| 0781657 | 7/1997 | European Pat. Off. . | |
| 821941 | 11/1951 | Germany | 101/DIG. 27 |

*Primary Examiner*—Edgar Burr
*Assistant Examiner*—Anthony H. Nguyen
*Attorney, Agent, or Firm*—Morgan & Finnegan, LLP

[57] ABSTRACT

The cylinder cleaning device according to the present invention is structured by independent components of a cleaning fabric supply element, a cleaning fabric take-up section, a cleaning fabric pressing section, and a brake section. The cleaning fabric supply element is formed by a flat box-form container. A shape-retaining member is provided on or in the vicinity of an inner surface of said container facing to a crease portion and/or a lateral portion of the cleaning fabric folded in multiplicity so as to act on the crease portion and/or the lateral portion of the cleaning fabric for retaining a folded shape of the cleaning fabric. The cleaning fabric supply element, the cleaning fabric take-up section, the brake section can desirably be arranged in a vacant space around the cylinder. Therefore, even in an existing machine the design for device structure is easy to design in a manner adapted for a vacant space without carrying out especial working.

20 Claims, 8 Drawing Sheets

CYLINDER CLEANING DEVICE

BACKGROUND OF THE INVENTION

1. Field of the Invention

This invention relates to a cylinder cleaning device which cleans away extraneous matter adhered to a surface of a blanket cylinder or a impression cylinder of an offset printing machine, in particular an offset sheet-fed printing machine, or a cylinder, roller, etc. of an apparatus such as a paper converting machine that deals with various kinds of papers or films, and more particularly to a cylinder cleaning device having a structure adapted for a narrow-width installation space.

2. Description of the Related Art

There have been proposed and placed into practical use various types of automatic cleaning devices having a cleaning fabric stretched between a cleaning fabric supply roll and a cleaning fabric take-up roll so as to be depressed by an urging means onto a cylinder or the like of a printing machine, thereby cleaning away dirt from a surface thereof. For example, such description is made in Japanese patent Publication No. S-563708.

One example of an automatic cleaning device of this kind will be explained as to structure with reference to FIG. 10. A cleaning fabric pressing means 2 for an automatic cleaning device 10 is provided oppositely to a blanket cylinder 1 as one of cylinders of a printing machine so as to wipe and clean away dirt such as ink, dust, or the like from a surface of the blanket cylinder 1. The cleaning fabric pressing means 2 is provided with a pressure pad 23 for pressing a cleaning fabric 3 against the surface of the blanket cylinder. The pressure pad 23 is expanded by the supply of air and contracted by discharging the air. The cleaning fabric 3 is urged onto the surface of the blanket cylinder in a state of expansion of the pressure pad. A cleaning fabric supply roll 4 for supplying the cleaning fabric 3 and a take-up shaft of a cleaning fabric take-up roll 5 are arranged at locations on the side of a cylinder 1 of a step 6, which an operator is to get on, and below a safety cover 8. Reference character 13 is a stay as a cross beam that is bridged to a frame 14 of the printing machine.

The cleaning fabric pressing means 2 is structured such that it can be moved as mentioned by an actuator, not illustrated. That is, the cleaning fabric pressing means 2 is detached from the blanket cylinder during usual printing, but during cleaning it approaches the blanket cylinder. The blanket cylinder, during cleaning, is rotated at a moderate speed (at a speed slower than that during usual printing) in a direction of the arrow. The pressure pad is expanded by the supply of air due to beginning of cleaning so that it in the expansion state cause the clean fabric to be pressed against the surface of the blanket cylinder, thereby wiping dirt therefrom. The cleaning fabric is fed continuously or intermittently by the rotation of the cleaning fabric take-up roll due to driving the take-up shaft. After ending the cleaning, the pressure pad is contracted by discharging the air therefrom. In this contraction state, the cleaning fabric is detached from the surface of the blanket cylinder to halt taking-up in the cleaning fabric take-up roll, thereby ending the operation of cleaning.

Recently, there have been developed small-sized, high-performance offset sheet-fed printing machines, which makes possible installation in relatively small space. For multi-color printing in particular, a plurality of printing machines are arranged in tandem. In a printing machine, there is a necessity to secure a space required for operator's operation, involving printing-plate replacement such as attaching plate to a plate cylinder 7 and detaching plate, replacement of a cleaning fabric for an automatic cleaning device 10, and so on. Particularly in the case of a multi-color offset sheet-fed printing machine, the operation space 11 that is provided between press units A and B adjacent to each other, for example, is approximately 50 cm for a space saving type, securing a width as small as a required minimum. Between the operation space 11 and the press unit A safety cover 8 is provided, wherein the spacing between the safety cover 8 and the blanket cylinder 1 is as small as about 4 cm in width. Therefore, it has been impossible to install there a cleaning fabric unit (one-body assembly of the cleaning fabric pressing section, the cleaning fabric supply roll, and cleaning fabric take-up shaft) for an automatic cleaning device.

The offset sheet-fed printing machine in many cases has a structure arranged, as shown in the figure, by a blanket cylinder 1 at a lower location and a plate cylinder 7 at an upper location so that a device for cleaning the blanket cylinder is placed on the side of the operating space.

The cleaning fabric unit of the conventional automatic cleaning device is of a structure that is, for example, wide in a direction of a normal line with respect to the surface of the blanket cylinder 1. That is, the cleaning fabric supply roll 4 and the cleaning fabric take-up roll 5 are arranged at a back location of the pressure pad 23. The cleaning fabric supply roll and the cleaning fabric take-up roll are placed offset in directions of upper and lower or left and right, as viewed in the figure, to avoid interference therebetween. With such structure, there is increase in distance between the pressure pad and the cleaning fabric supply roll or the cleaning fabric take-up roll, so that the cleaning fabric unit is difficult in width to be placed between the safety cover and the blanket cylinder. Besides, there is a necessity of taking into consider the spacing required for moving the cleaning fabric unit between upon cleaning and non-cleaning.

The broadening in spacing, as a countermeasure to this, between the safety cover and the blanket cylinder greater than the width of the cylinder cleaning device is difficult in respect of the relation to the installation space for the entire printing machine. Besides, with an existing machine, there encounters further difficulty in terms of installation space and cost, as stated before. In practice, the installation space is secured by narrowing the width in the lower portion of the step 6 from the safety cover 8, that is, broadening toward the operation space to secure an installation space, so that the cleaning fabric unit is attached by the utilization of the extended space.

The securing part of the space for attaching the cylinder cleaning device toward the side of operation space results in reduction in width of the step 6, which an operator is to get on, by a corresponding amount. Furthermore, it is not preferred that an extension 12 is made left on the side of toes due to the installation space, unfavorably hindering workability.

Furthermore, where installing at a location other than between the safety cover and the blanket cylinder, there encounter restrictions in width of the automatic cleaning device due to relations to various devices and apparatuses.

It is therefore the object of the present invention to provide a cylinder cleaning device which is capable of being installed within a limited space given between a cylinder surface to be cleaned and a member opposite thereto.

SUMMARY OF THE INVENTION

The present invention lies in a structure that, in a cylinder cleaning device having a cleaning fabric, drawn from a cleaning fabric supply element and taken up by a cleaning fabric take-up means to be stretched therebetween, that is to be pressed by a pressing means against an outer periphery of a cylinder for cleaning a surface of the cylinder, the cylinder cleaning device characterized in that:

the cleaning fabric supply element has a container formed in a flat box form so as to store the folded cleaning fabric, container constituting cleaning fabric supply element.

In another embodiment, a shape-retaining member is provided on or in the vicinity of an inner surface of container, shape-retaining member being abutable against a crease portion and/or lateral edge portion of the folded cleaning fabric to maintain a stored shape of the folded cleaning fabric.

Also, a brake means is provided for applying a brake to the cleaning fabric being drawn from the cleaning fabric supply element.

Also, a cleaning fabric guide member is provided at a cleaning fabric exit through which the cleaning fabric is drawn from the container.

Further, the cleaning fabric supply element, the cleaning fabric take-up means and the pressing means are formed by respective independent components so as to be altered in position of arrangement in accordance with a space provided around the cylinder.

Also, the shape-retaining member is formed by a friction applying member.

Preferably, the friction applying member is provided with a plurality of engaging projections in a surface thereof, the engaging projections is formed by a member to act on the crease portion and/or a lateral edge portion of the folded cleaning fabric or a brush-like member.

In another embodiment, an urging means is provided for acting an urging force upon a cloth surface of the folded cleaning fabric in a direction from a wall to another wall of the container.

Also, where the urging means is comprised a cleaning fabric guide member for guiding the cleaning fabric in a direction of a cleaning fabric exit, and a means for forcing cleaning fabric guide member in a direction from a wall to another wall of the container.

Also, a fixed cleaning fabric guide member is arranged in the vicinity of the cleaning fabric exit on an outer side of the container.

In the above structure, the cleaning fabric supply element is formed in a flat container, for example a corner cubic box, a round corner cubic box forming by a poor material of flexibility. Therefore, where an installation space in a machine such as a printing machine is narrow, if at least a width of a shorter side of the cleaning fabric is secured, the cleaning fabric supply element can be arranged there. Thus, the cleaning device can be installed without extending the space toward the step provided for operating the machine. The cleaning fabric accommodated in the container is maintained in a multi-folded state by a shape-retaining member provided inside the container, the cleaning fabric can be smoothly drawn out of the container without being tangled. Furthermore, since the cleaning fabric is held by the shape-retaining member, the cleaning fabric can be placed horizontally and vertically, thus enhancing freedom in layout for device arrangement.

By using the cleaning fabric supply element thus structured, it is possible to desirably arrange the cleaning fabric supply element or the cleaning fabric take-up means in a vacant space around the cylinder. Therefore, even in an existing machine the design for device structure is easy to design in a manner adapted for a vacant space without carrying out especial working.

DETAILED DESCRIPTION OF THE PREFERRED EMBODIMENTS

Figure 1:
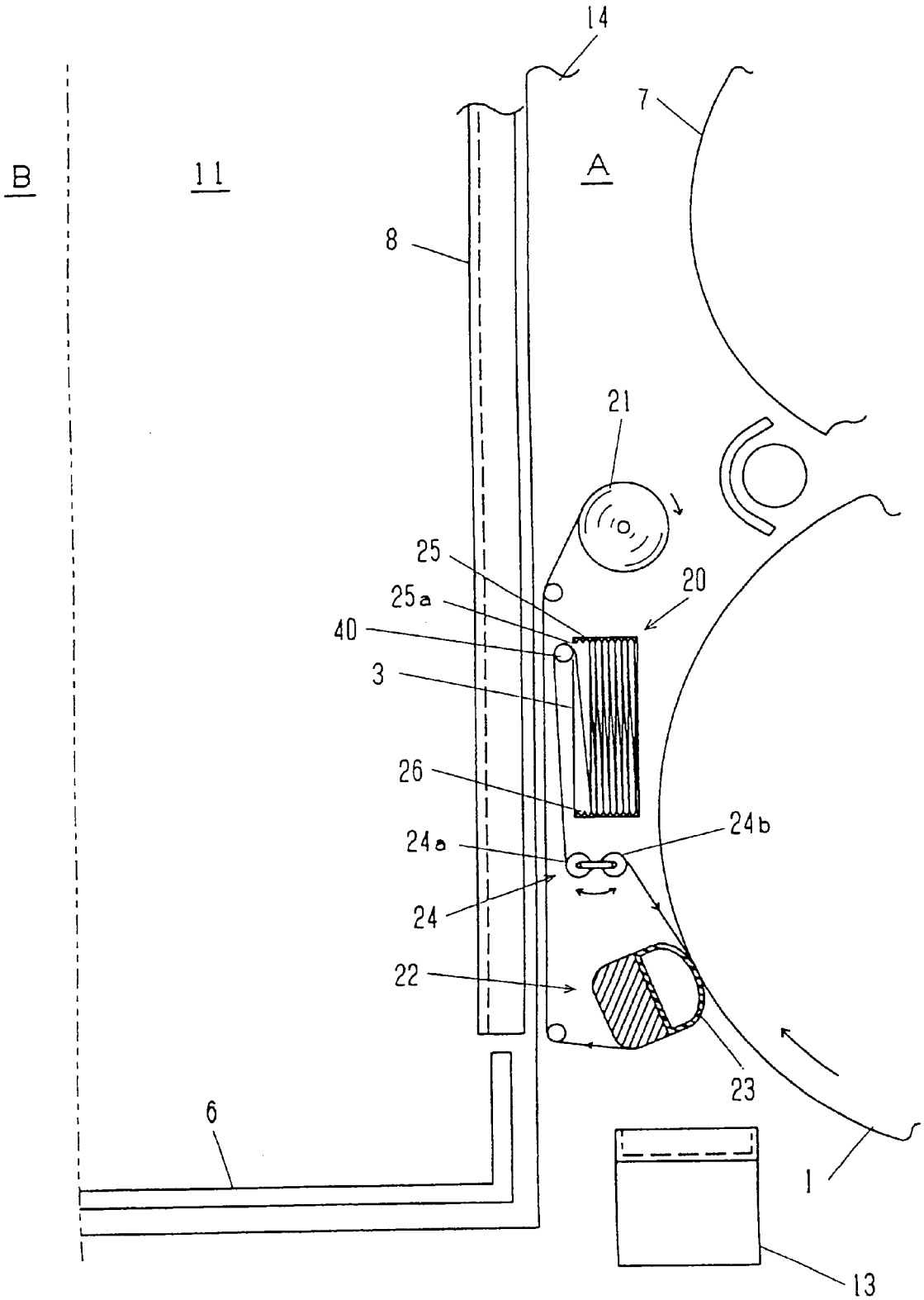
FIG. 1 is a structural view of an embodiment of the present invention in a state installed in a printing machine.
Figure 10:
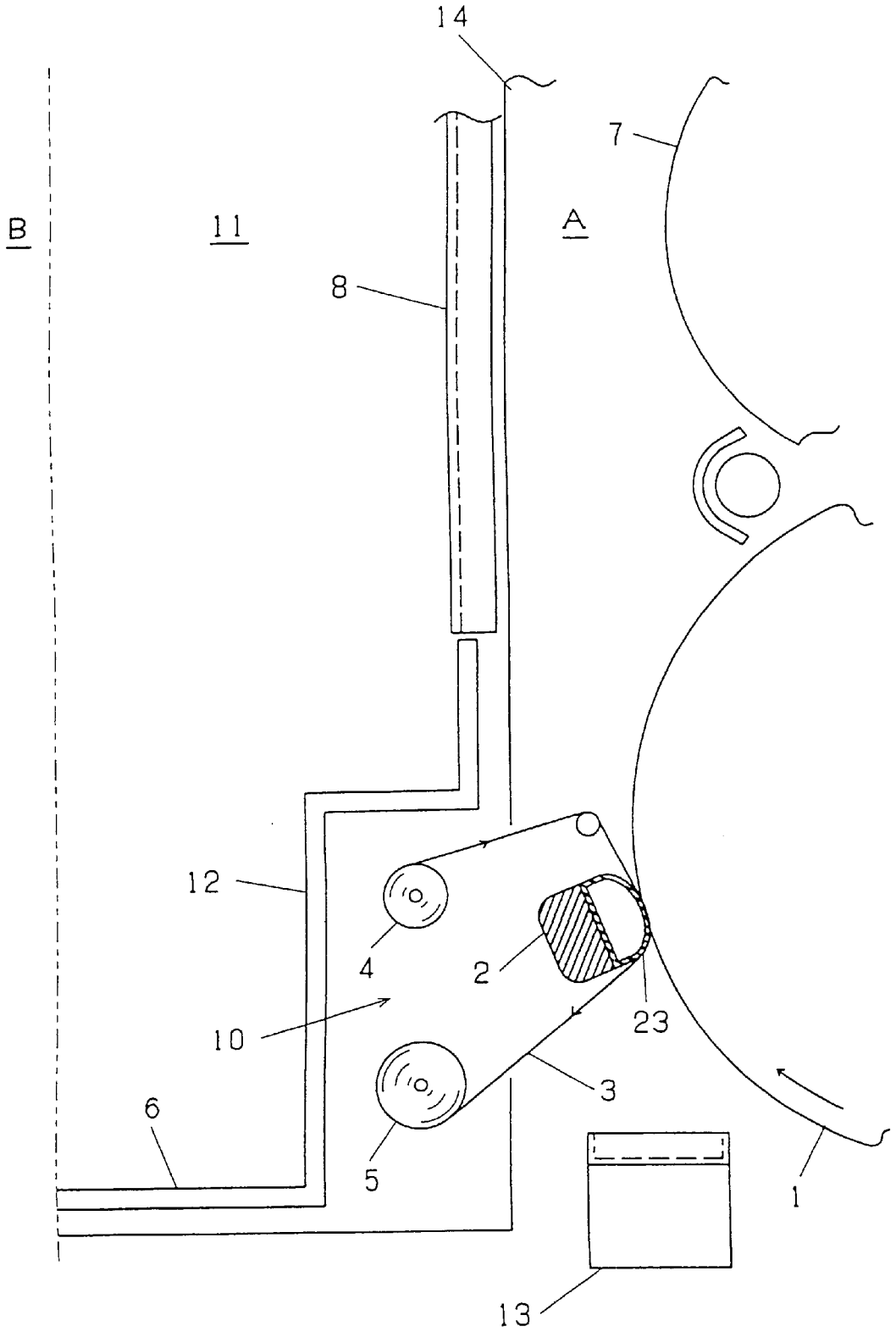
Fig. 10 PRIOR ART
FIG. 10 is an explanatory view of a conventional automatic cleaning device.

There will be explained embodiments of the present invention with reference to the drawings. FIG. 1 shows a structure in a state that one embodiment of the present invention is installed in a printing machine. In the figure, corresponding parts or elements are given of same reference numerals as those in FIG. 10, omitting explanations. The present embodiment has a cylinder cleaning device installed at a space between a safety cover and a blanket cylinder.

The cylinder cleaning device comprises, as its basic structure, a cleaning fabric supply element 20 for supplying a cleaning fabric 3 that is folded to be accommodated therein, a cleaning fabric take-up section 21 for taking up a cleaning fabric drawn out of the cleaning fabric supply element 20, and a cleaning fabric pressing section 22 having a pressure pad 23 for pressing the cleaning fabric stretched between the cleaning fabric supply element 20 and cleaning fabric take-up section 21 against an outer periphery of a cylinder 1.

In order to prevent the cleaning fabric 3 being pressed by the pressure pad 23 against the surface of the blanket cylinder 1 from being pulled out of the cleaning fabric supply element 20 due to rotation of the blanket cylinder during cleaning, there is provided a cleaning fabric braking section 24 on an upstream side with respect to supply of the cleaning fabric to the pressure pad. In the present embodiment, two rollers 24*a* and 24*b* coupled to each other are rotatably arranged in a manner transverse a direction of supplying the cleaning fabric 3 between the cleaning fabric supply element 20 and the cleaning fabric pressing section 22. The two rollers are passed by the cleaning fabric 3 in an S-character form so that the roller, when changed in coupling angle, is increased in area of contact with the cleaning fabric to cause friction, generating a brake force.

Here, the cleaning fabric take-up section 21 constitutes a cleaning fabric take-up means for taking up for treating the cleaning fabric drawn out of the cleaning fabric supply element 20. The cleaning fabric pressing section 22 having the pressure pad 23 forms a pressing means for pressing the cleaning fabric being stretched between the cleaning fabric supply element 20 and the cleaning fabric take-up section 21 against the outer periphery of the cylinder 1.

By making as independent components the cleaning fabric supply element 20, cleaning fabric take-up section 21 and the cleaning fabric pressing section 22, they can be arranged to meet the space for installing the cylinder cleaning device, facilitating layout in placing the cylinder cleaning device for each printing unit. In the present embodiment, the cleaning fabric supply element 20, the cleaning fabric take-up section 21 and the cleaning fabric pressing section 22 are placed straightly in one line form in a vertical direction, which are directly attached to a frame 14 of the printing machine.

The pressure pad 23 of the cleaning fabric pressing section faces almost rectangular to the direction of placing the cleaning fabric supply element 20, the cleaning fabric take-up section 21 and the cleaning fabric pressing section 22. The cleaning fabric supply element 20 is provided with a container 25 in a flat box shape, for example a corner cubic box, a round corner cubic box, etc. that accommodates by folding the cleaning fabric 3. At FIG. 1, The flat box container is vertically placed (in vertical arrangement) so that the cleaning fabric 3 is drawn out through a cleaning fabric exit 25*a* at an upper position thereof. For example, in the case of an offset sheet-fed printing machine, the quantity of cleaning fabric 3 contained in a cleaning fabric supply element in usual cases is about 13 meter. This cleaning fabric if folded by a length of 100 mm will become 130 layers. If the thickness of the cleaning fabric is considered 0.2 mm, the total thickness of the folded cleaning fabric becomes about 3 cm.

Figure 2:
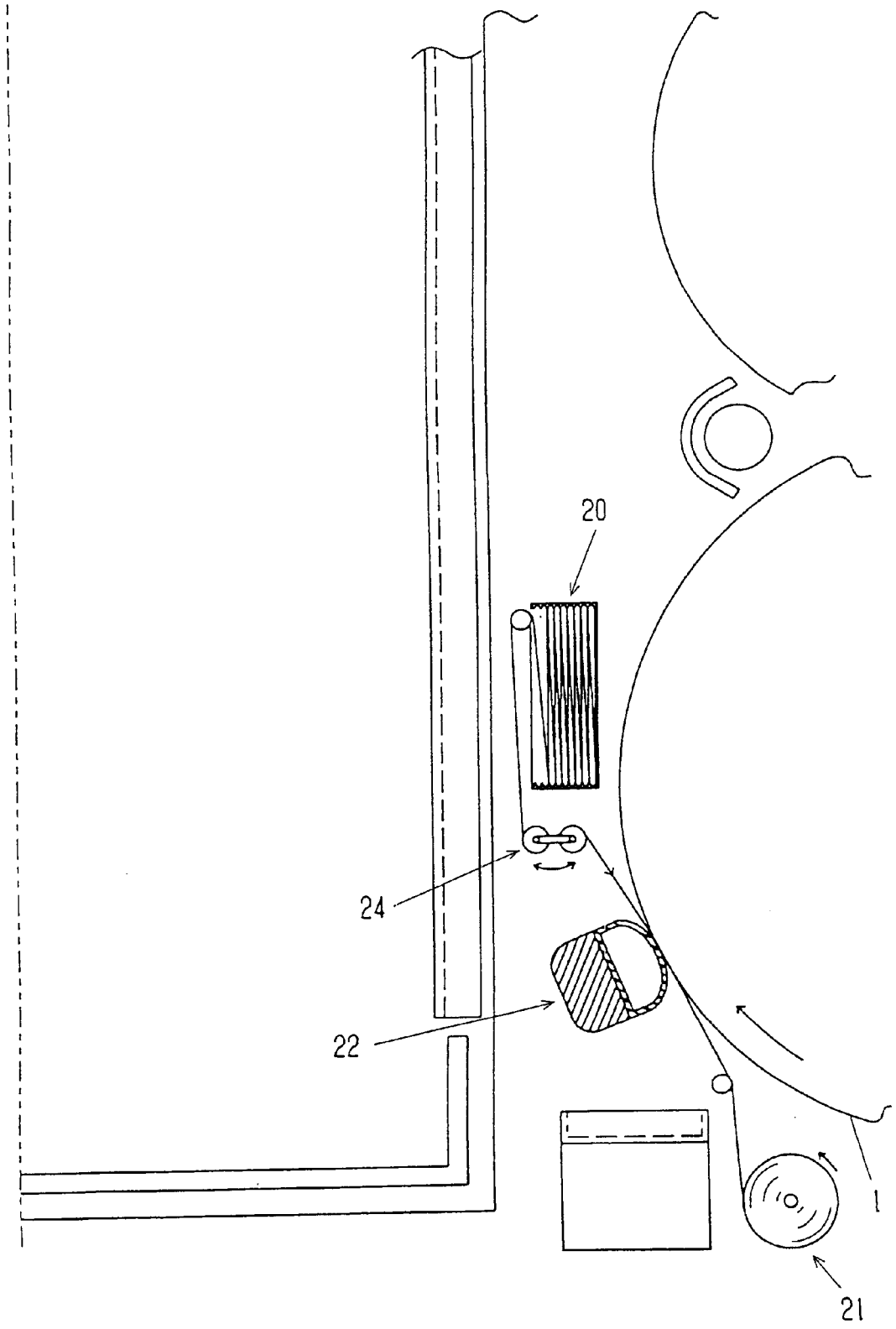
FIG. 2 is a structural view modified in arrangement of a cleaning fabric take-up section.

FIG. 2 shows a structure modified in position of the cleaning fabric take-up section. The cleaning fabric take-up section is provided at such a space, if secured, that is below the blanket cylinder 1 and at a side of a stay 13. The arrangement of the other components, i.e., the cleaning fabric supply element 20, the cleaning fabric pressing section 22 and the cleaning fabric braking section 24, is similar to that of the embodiment shown in FIG. 1.

Figure 3:
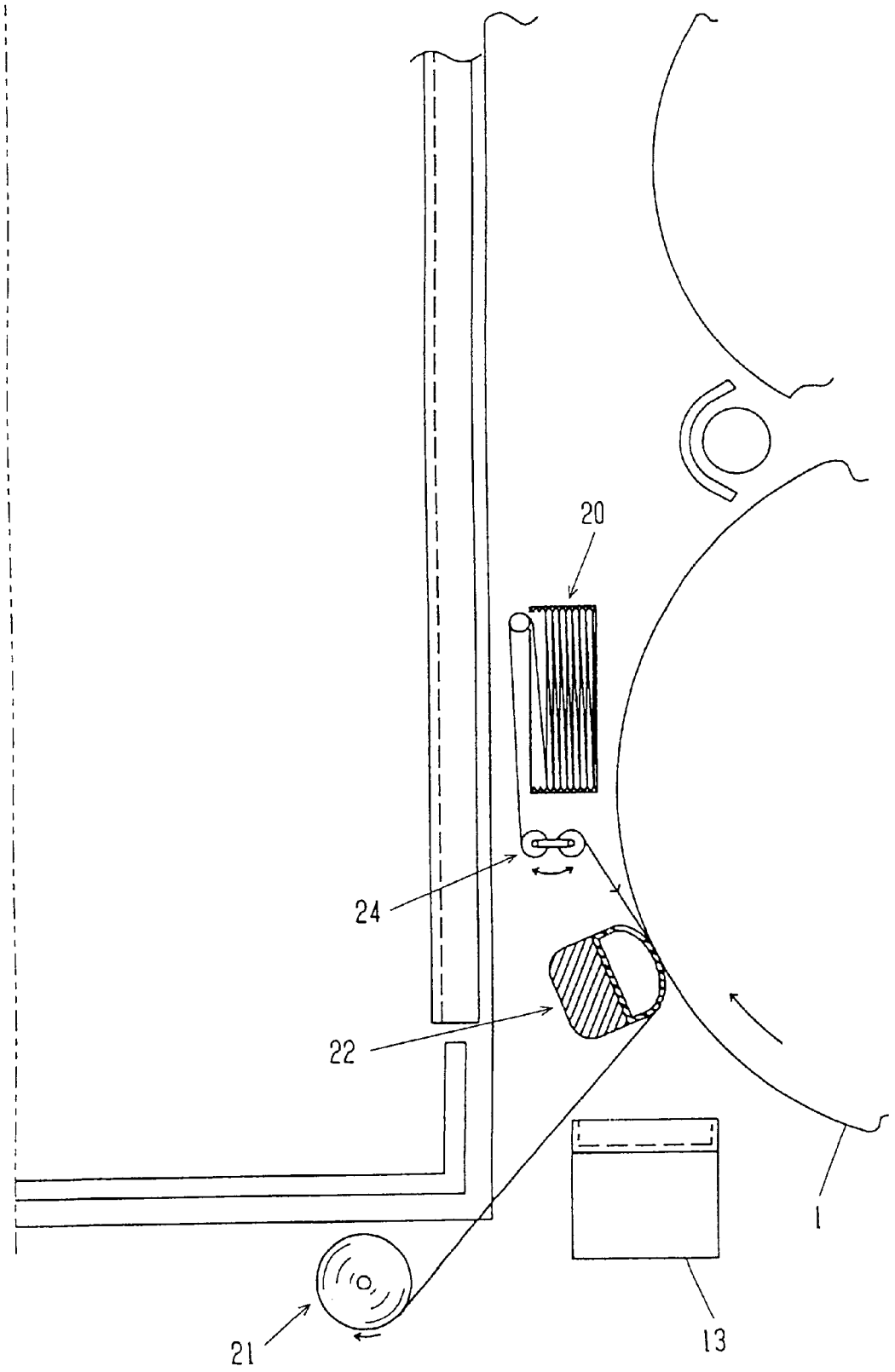
FIG. 3 is another structural view modified in arrangement of the cleaning fabric take-up section.

FIG. 3 shows another structure modified in position of the cleaning fabric take-up section. In this embodiment an installation space is secured at a location beneath a step 6 so that the cleaning fabric take-up section 21 is arranged in that space. The arrangement of the other components is similar to the embodiment of FIG. 1. By adopting the arrangement of the cleaning fabric take-up section in this manner, there can be provided a wide space between a safety cover located above the cleaning fabric supply element and the blanket cylinder.

Figure 4:
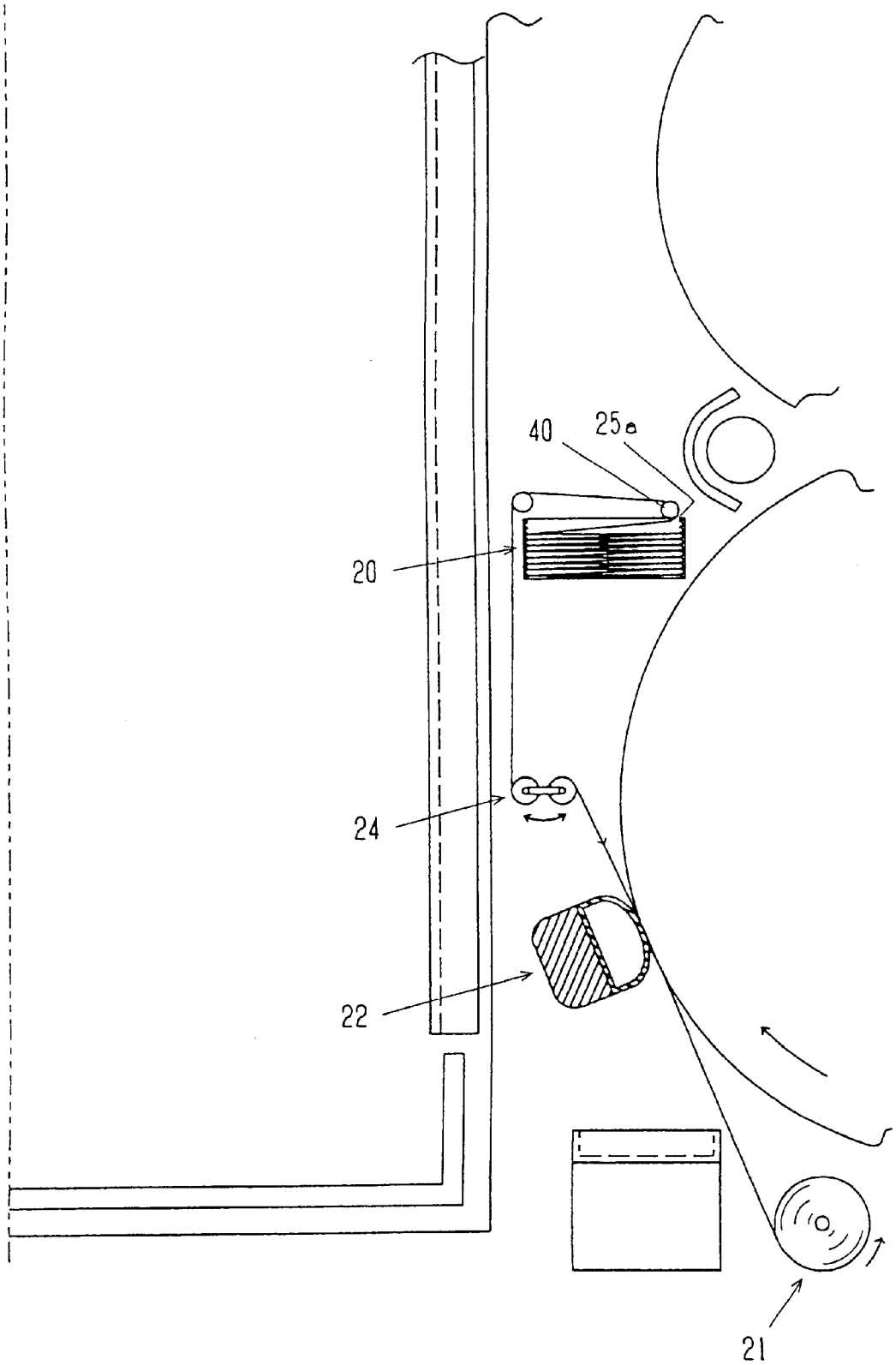
FIG. 4 is a structural view of an embodiment wherein a cleaning fabric supply element is horizontally placed.

FIG. 4 shows a structure of an embodiment wherein the flat box container constituting a cleaning fabric supply element is horizontally placed. The cleaning fabric is folded in multiplicity to be accommodated within the container with creases thereof vertically aligned, so that it is drawn through a cleaning fabric exit 25*a* positioned at an upper point of the container. At the cleaning fabric exit 25*a*, a cleaning fabric guide member 40 is arranged which is comprised of a rotatable guide roller or a non-rotatable shaft having a low frictional resistance.

Figure 5:
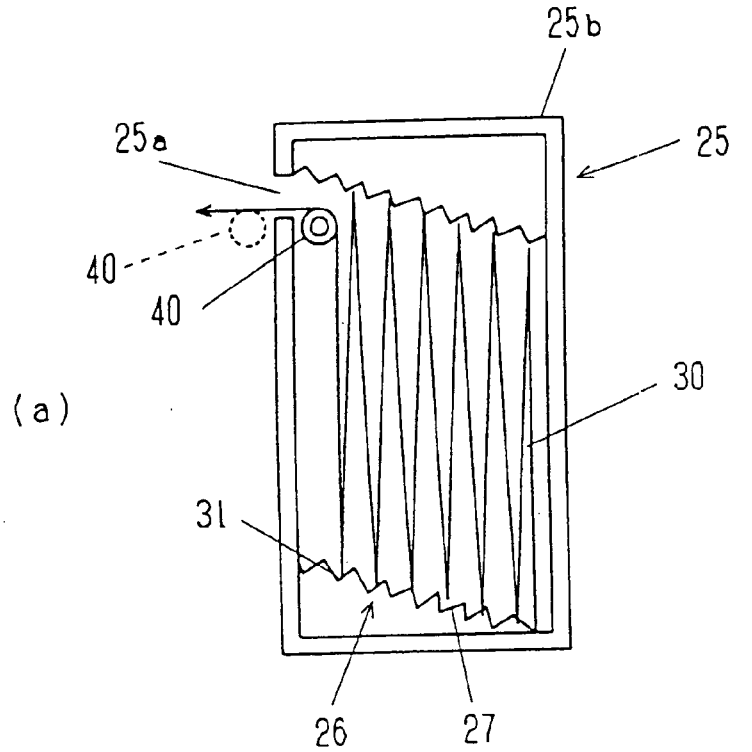
FIG. 5 is a sectional view of the cleaning fabric supply element.
Figure 5:
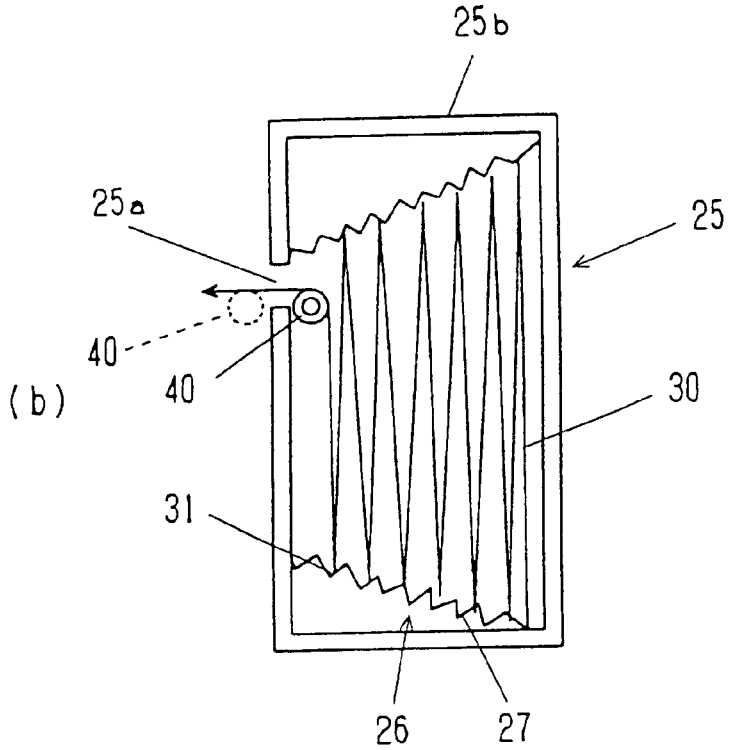

The structure of the cleaning fabric supply element will then be explained in detail. FIG. 5 shows a section of the cleaning fabric supply element accommodating a multi-folded cleaning fabric within the container.

The container 25 is of a flat structure rectangular in section so as to accommodate the multi-folded cleaning fabric 3 in a manner such that crease portions 31 thereof are respectively positioned facing to shorter sides 25*b*. The container has a shape-retaining member 26 provided inside thereof to retain the multi-folded state of the cleaning fabric. The cleaning fabric guide member 40 is arranged on an inner side and/or an outer side of the container in the vicinity of the cleaning fabric exit 25*a*. Incidentally, the "retaining" means to maintain the shape prior to use of a cleaning fabric in a multi-folded state accommodated in the container, and to maintain a changed form in the multi-folded state of the cleaning fabric remained in the container during the use process of being drawn out of the container.

Figure 6:
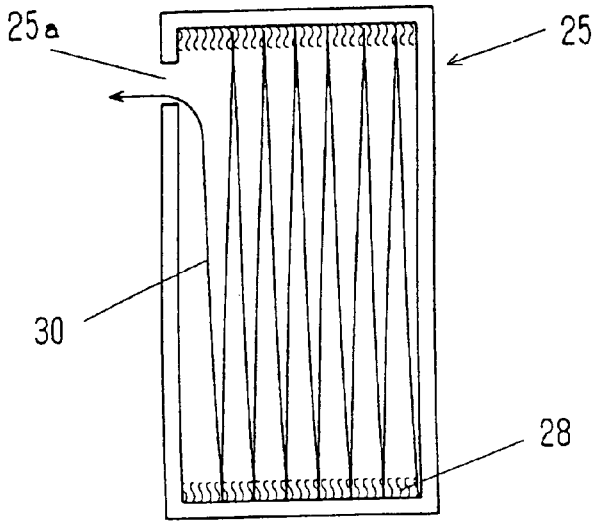
FIG. 6 is a sectional view of a cleaning fabric supply element, showing another embodiment of a shape-retaining member for acting on a crease portion of the cleaning fabric.
Figure 7:
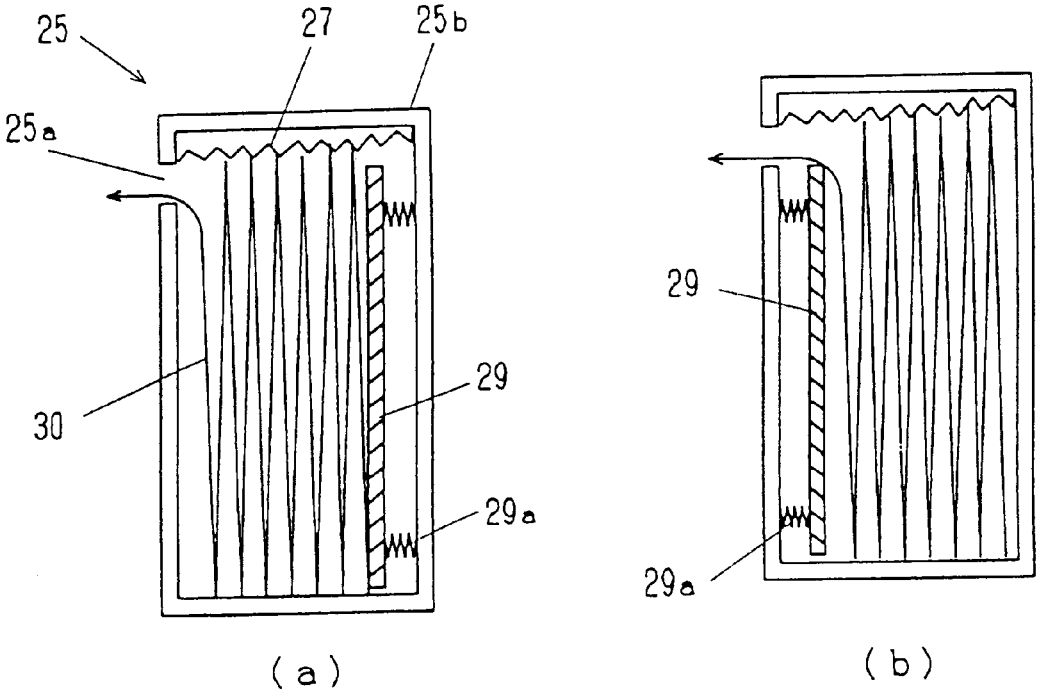
FIGS. 7*a* and 7*b* are sectional views of the cleaning fabric supply element provided with a shape-retaining member and an urging member.

The shape-retaining member 26 is provided close to an inner surface of the container as shown in FIG. 5, or otherwise on an inner surface opposite to the crease portion 31 of the cleaning fabric as shown in FIG. 6. The shape-retaining member 26 provided at the sorter side is formed by a plane-form fastener 27 as shown in FIG. 5, or a brush-form member such as a brush 28 or the like so that it contacts with the crease portion 31 of the cleaning fabric, maintaining the multi-folded state of the cleaning fabric by their frictional effects. Here, the plane-form fastener 27 has a fiber in a hook or pile form formed on a surface of a fabric, for which a commodity sold under the registered trademarks of, for example, MAGIC TAPE or BERUKURO, etc., may be employed. Furthermore, where the multi-folded cleaning fabric is urged at a fabric surface thereof so as to maintain the shape, an urging member 29 urged by springs 29*a* is structured so that it urges the cleaning fabric in a direction toward the cleaning fabric exit 25*a* (FIG. 7 (*a*)) or in a direction away from the cleaning fabric exit (FIG. 7(*b*)).

Figure 8:
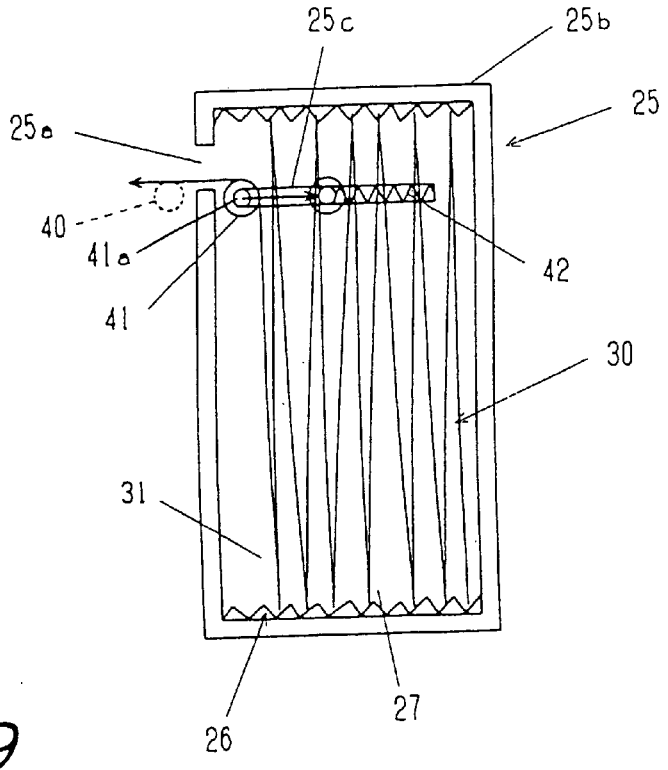
FIG. 8 is a sectional view having an urging member formed by a movable roller.

FIG. 8 shows a modification of an urging member. In this embodiment, the rotatable guide roller shown in FIG. 5 is arranged movable from the cleaning fabric exit 25*a* in a direction of folding of the multi-folded cleaning fabric.

Guide holes 25*c* are formed in the respective side walls adjacent to the cleaning fabric exit 25*a* of the container 25, which extend in a direction away from the cleaning fabric exit 25*a*. In the guide holes 25*c*, a movable cleaning fabric guide member 41 is provided, which is formed by a roller shaft 41*a* movably and guidably fitted therein and a rotatable guide roller provided on this roller shaft or a non-rotatable shaft having a low frictional resistance. Between the shaft 41*a* of the movable cleaning fabric guide member 41 and the side wall, a spring 42 is provided so as to urge always the movable cleaning fabric guide member 41 in the direction of folding of the multi-folded cleaning fabric 30, thus depressing the fabric surface of the cleaning fabric. Alternatively, a fixed cleaning fabric guide member may be arranged on the outside of the container in the vicinity of the cleaning fabric exit 25*a*. The method of fixing the cleaning fabric guide member 40 is by attaching directly to the outer side of the container, or to a machine frame or a separate frame to the machine frame.

Where structuring a shape-retaining member by a plane-form fastener 27, shape-retaining members 26 are provided entirely or partly on both shorter sides inside the container which are slanted in a direction away from the cleaning fabric exit 25*a* with respect to the inner surface of the shorter side. The slant for the respective retaining portions involves a placing structure that assumes opposite two sides of a parallelogram as shown in FIG. 5(*a*) and a placing structure assuming lateral sides of a trapezoid as shown in FIG. 5(*b*).

Figure 9:
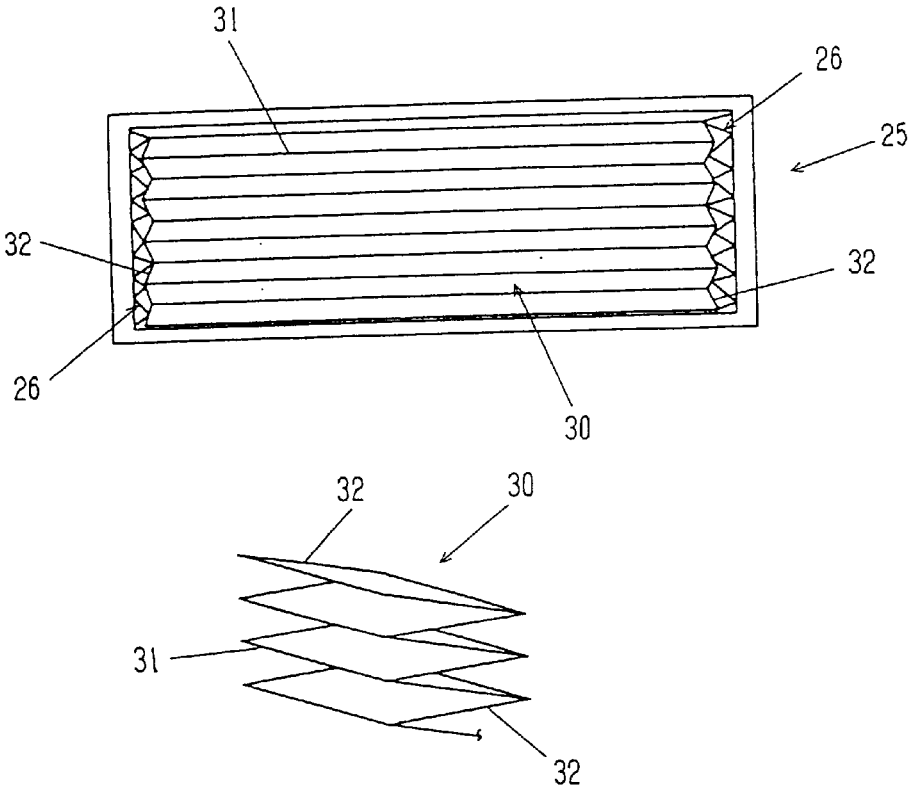
FIG. 9 is a structural view of the shape-retaining member that acts on a lateral edge portion of the cleaning fabric.

FIG. 9 shows a structure of another embodiment of a shape-retaining member. The shape-retaining member 26 is arranged on or in the vicinity of an inner surface of the container facing to a lateral portion 32 of the cleaning fabric 30 perpendicular to a crease thereof, having a structure of contacting with the lateral portion 32. To this shape-retaining member 26, the structure shown in FIG. 5 or FIG. 6 is applicable.

By arranging the shape-retaining member like this on or in the vicinity of the inner surface of the container facing to the crease portion and/or lateral portion of the cleaning fabric, if the cleaning fabric is drawn out of the container, the remaining cleaning fabric is always acted at the crease portion and/or the lateral portion by the shape-retaining member. Therefore, the state of fold is maintained for the cleaning fabric in a manner commensurate with the remaining quantity so that the drawing of the cleaning fabric is smoothly effected until it is used up.

The embodiment of the present invention is not limited to the above examples, but can be practiced by the following structures.

(1) The cleaning fabric is folded in a vertical direction (in an overlapping direction).

(2) A shape-retaining member is provided on or in the vicinity of the inner surface of the shorter side, and further an urging plate is provided on the opposite side to the cleaning fabric exit, i.e., the back surface of the cleaning fabric in a manner urging the cleaning fabric toward the cleaning fabric exit.

(3) Within the container are provided both of a shape-retaining member acting on the crease portion of the cleaning fabric and a shape-retaining member that acts on the lateral portion of the cleaning fabric.

(4) If the shape-retaining member is one that acts to contact with the crease-face portion or the lateral portion of the cleaning fabric, it is formed in a structure with a bellows-form surface or a structure having fine projections comparatively densely formed therein.

(5) The cleaning fabric take-up means is formed by a structure of cutting by a cutter, in place of the cleaning fabric take-up section.

(6) The cleaning fabric braking section may be of any form if it can act to apply brake to the cleaning fabric. For example, there is a method of applying brake by depressing the cleaning fabric at opposite surfaces using brake shoes.

(7) Either vertical arrangement or horizontal arrangement is applicable to the flat container constituting the cleaning fabric supply element.

(8) The cleaning fabric pressing section, the cleaning fabric supply roll and the cleaning fabric take-up roll shaft may be arranged indirectly on the printing machine frame, that is, these components are assembled on a separate frame into one body to be attached to the printing machine.

(9) The cleaning fabric may be formed by a usual fabric, a non-woven fabric, plastic film or their processed forms, or similar ones. As a processed cleaning fabric, a cleaning fabric impregnated beforehand with a liquid, and a cleaning fabric having a jelly or pasty cleaning agent applied thereon may be used.

(10) As a structure for moisten the cleaning fabric, it is possible to appropriately select a method such as setting up a spray device for injecting a cleaning liquid against the cleaning fabric or using a cleaning fabric impregnated beforehand with a cleaning liquid.

What is claimed is:

1. A cylinder cleaning device for cleaning a cylinder of a press, the device comprising:

a container formed as a flat box located in parallel to the cylinder to be cleaned and containing a folded cleaning fabric to be drawn out thereof, said folded cleaning fabric having crease portions and a surface;

wherein said container has a first dimension generally parallel to the cylinder, a second dimension, and a third dimension, said second dimension being shorter than said third dimension such that said container is in the form of the flat box.

2. The container of claim 1 wherein said second dimension is along the crease portions and said third dimension is along the surface of the folded cleaning fabric.

3. A cylinder cleaning device according to claim 1, further including a brake means for applying a brake to the drawn cleaning fabric stretched between said cleaning fabric supply element and said cleaning fabric take-up means.

4. A cylinder cleaning device according to claim 1, wherein said container has a cleaning fabric exit through which the cleaning fabric is drawn and a cleaning fabric guide member arranged at a cleaning fabric exit for guiding the cleaning fabric being drawn out.

5. A cylinder cleaning device according to claim 1, further comprising a cleaning fabric take-up means for taking up cleaning fabric drawn from said container so that the drawn cleaning fabric is stretched between said container and the cleaning fabric take-up means; and a pressing means for pressing the stretched cleaning fabric against of the cylinder to be cleaned up; and wherein said cleaning fabric supply element, said cleaning fabric take-up means, and said pressing means comprising separate components, alterable in position in accordance with a space available around the cylinder.

6. A cylinder cleaning device according to claim 1, further including an urging means for providing an urging force upon a cloth surface of the folded cleaning fabric in a direction from a wall to another wall of the container.

7. A cylinder cleaning device according to claim 6, wherein the container further comprises a cleaning fabric exit and wherein said urging means is comprised of a cleaning fabric guide member for guiding the cleaning fabric in a direction of said cleaning fabric exit, and a means for forcing said cleaning fabric guide member in a direction from a wall to another wall of the container.

8. A cylinder cleaning device according to claim 7, further including a fixed cleaning fabric guide member provided in the vicinity of said cleaning fabric exit and on an outer side of said container.

9. A cylinder cleaning device for cleaning a cylinder of a press, the device comprising:

a container means for storing a folded cleaning fabric to be drawn out thereof;

a cleaning fabric take-up means for taking up cleaning fabric drawn from said container so that the drawn cleaning fabric is stretched between said container and the cleaning fabric take-up means; and a pressing means for pressing the stretched cleaning fabric against of the cylinder to be cleaned up; and a shape-retaining member formed on or in the vicinity of an inner surface of said container, said shape-retaining member being abutable against a crease portion and/or lateral edge portion of the folded cleaning fabric to maintain a stored shape of the folded cleaning fabric.

10. A cylinder cleaning device according to claim 9, further including a brake for applying a brake to the drawn cleaning fabric stretched between said container and said cleaning fabric take-up means.

11. A cylinder cleaning device according to claim 9, wherein said container has a cleaning fabric exit through which the cleaning fabric is drawn and a cleaning fabric guide member arranged at a cleaning fabric exit for guiding the cleaning fabric being drawn out.

12. A cylinder cleaning device according to claim 9, wherein said shape-retaining member is formed by a friction applying member.

13. A cylinder cleaning device according to claim 12, wherein said friction applying member is formed in a surface thereof with a plurality of engaging projections, said engaging projections being formed by a member for abutment against the crease portion and/or the lateral edge portion of the folded cleaning fabric.

14. A cylinder cleaning device according to claim 12, wherein said friction applying member is formed by a brush-like member.

15. A cylinder cleaning device according to claim 9, further including an urging means for providing an urging force upon a cloth surface of the folded cleaning fabric in a direction from a wall to another wall of the container.

16. A cylinder cleaning device according to claim 15, wherein the container further comprises a cleaning fabric exit and wherein said urging means is comprised of a cleaning fabric guide member for guiding the cleaning fabric in a direction of said cleaning fabric exit, and a means for forcing said cleaning fabric guide member in a direction from a wall to another wall of the container.

17. A cylinder cleaning device according to claim 16, further including a fixed cleaning fabric guide member provided in the vicinity of said cleaning fabric exit and on an outer side of said container.

18. A container storing folded cleaning fabric for cleaning a cylinder of a press, wherein the folded cleaning fabric has crease portions, the container comprising a shape-retaining surface inside the container and abutable against at least one crease portion of the folded cleaning fabric to maintain a shape thereof.

19. The container of claim 18 wherein said shape-retaining surface includes a plurality of engaging surfaces.

20. The container of claim 18 wherein said shape-retaining surface includes a plurality of brush members.

* * * * *